US009761088B2

(12) United States Patent
Kirnstötter

(10) Patent No.: US 9,761,088 B2
(45) **Date of Patent: *Sep. 12, 2017**

(54) MULTIPLAYER GAMING SYSTEM

(71) Applicant: NOVOMATIC AG, Gumpoldskirchen (AT)

(72) Inventor: Florian Kirnstötter, Vienna (AT)

(73) Assignee: NOVOMATIC AG, Gumpoldskirchen (AT)

( * ) Notice: Subject to any disclaimer, the term of this patent is extended or adjusted under 35 U.S.C. 154(b) by 0 days.

This patent is subject to a terminal disclaimer.

(21) Appl. No.: 15/359,351

(22) Filed: Nov. 22, 2016

(65) Prior Publication Data

US 2017/0076554 A1 Mar. 16, 2017

Related U.S. Application Data

(63) Continuation of application No. 14/286,448, filed on May 23, 2014, now Pat. No. 9,508,228, which is a (Continued)

(30) Foreign Application Priority Data

Nov. 23, 2011 (GB) ..... 1120211.6

(51) Int. Cl.
*G07F 17/32* (2006.01)

(52) U.S. Cl.
CPC ..... *G07F 17/3286* (2013.01); *G07F 17/3225* (2013.01); *G07F 17/3262* (2013.01); *G07F 17/3276* (2013.01)

(58) Field of Classification Search
CPC .... A63F 9/24; G07F 17/3286; G07F 17/3262; G07F 17/3225; G07F 17/3276
See application file for complete search history.

(56) References Cited

U.S. PATENT DOCUMENTS 5,588,650 A 12/1996 Eman et al.
9,508,228 B2 11/2016 Kirnstötter
(Continued)

FOREIGN PATENT DOCUMENTS

WO WO 2013/075838 5/2013

OTHER PUBLICATIONS

"Statistics—Simple Random Sampling" accessed and printed from URL <https://www.tutorialspoint.com/cgi-bin/printpage.cgi>, 1 page.*

*Primary Examiner* — Jason Skaarup
(74) *Attorney, Agent, or Firm* — Levine Bagade Han LLP

(57) ABSTRACT

The present invention generally relates to gaming systems for playing ball games where a hall is launched into a gaming area. More particularly, the present invention relates to a multiplayer gaming system comprising a ball game device having a launching mechanism for launching a ball into a gaming area to start a game, the gaming system further comprising a start control means for controlling start of the launching mechanism and a plurality of gaming terminals for a plurality of players, said gaming terminals including an input device for inputting a prediction and/or a bet for the outcome of a game. In accordance with the present invention, the input device of each gaming terminal includes start signal input means for inputting a start signal for starting the launching mechanism, wherein the start control means of the gaming system includes a random signal generator for randomly selecting one of the plurality of gaming terminals for each game to generate the start signal and a display signal generator for generating a display signal indicative of the gaming terminal selected for the generation of the start signal.

14 Claims, 5 Drawing Sheets

Related U.S. Application Data continuation of application No. PCT/EP2012/004855, filed on Nov. 23, 2012.

(56) References Cited

U.S. PATENT DOCUMENTS

| | | | | |
|---|---|---|---|---|
| 2002/0169017 | A1* | 11/2002 | Visoenik | G07F 17/38 463/17 |
| 2005/0003885 | A1 | 1/2005 | Rhoten | |
| 2005/0014550 | A1 | 1/2005 | Rhoten | |
| 2006/0052149 | A1* | 3/2006 | Bursill | G06Q 50/34 463/16 |
| 2007/0077990 | A1* | 4/2007 | Cuddy | G07F 17/32 463/25 |
| 2009/0258696 | A1 | 10/2009 | Chim | |
| 2010/0124966 | A1 | 5/2010 | Kido | |
| 2010/0144419 | A1 | 6/2010 | Miltenberger et al. | |
| 2010/0210337 | A1 | 8/2010 | Okada | |
| 2012/0034968 | A1 | 2/2012 | Watkins et al. | |
| 2012/0077569 | A1 | 3/2012 | Watkins et al. | |
| 2014/0256398 | A1 | 9/2014 | Schrotter | |

* cited by examiner

MULTIPLAYER GAMING SYSTEM

CROSS-REFERENCE TO RELATED APPLICATIONS

The present application is a continuation of U.S. application Ser. No. 14/286,448, filed May 23, 2014, which is a continuation of PCT Application No. PCT/EP2012/004855, filed Nov. 23, 2012, which claims the benefit of U.K. Patent Application No, 1120211.6, filed on Nov. 23, 2011, all of which are incorporated by reference herein in their entireties.

BACKGROUND

The present invention generally relates to gaming systems for playing ball games where a ball is launched into a gaming area. More particularly, the present invention relates to a multiplayer gaming system comprising a ball game device having a launching mechanism for launching a ball into a gaming area to start a game, the gaming system further comprising a start control means for controlling start of the launching mechanism and a plurality of gaming terminals for a plurality of players, said gaming terminals including an input device for inputting a prediction and/or a bet for the outcome of a game, wherein the input device of at least some of the gaming terminals includes start signal input means for inputting a start signal for starting the launching mechanism.

In certain ball games such as roulette or pachinko, a ball may roll on as gaming area and the outcome of a game is determined by the section of the gaming area where the ball stops. Depending upon where the ball stops, a player may win or lose a bet or a prediction where such bets and predictions may include wagering money or not. For example, in case of roulette, the gaming area may include a spinning wheel having a ring of pockets or landings, wherein a ball may be launched onto the spinning wheel, typically in the direction opposite to the direction of rotation of the spinning wheel. The bet or prediction outcomes are based on which landing is the stopping place of the ball.

In such ball games, the launch of the ball into the gaming area may have some relevance to the outcome of the game, wherein launching speed and launching direction may have influence as well as the point of time at which the ball is launched since such point of time affects the launching position of the ball relative to the spinning wheel. Consequently, such launching action needs to be effected in a secure and trustworthy way so as to avoid increased occurrence of certain outcomes and to establish players' confidence in the system. Aside from such safety and manipulation aspects, there is also a continuous need to increase the level of interest, excitement and volatility associated with playing such ball games.

In order to avoid the very basic shortcomings and undue effects of manually launching the ball onto the rotor, it already has been suggested to use automatic launching mechanisms which may launch the ball into the gaming area semi-automatically, e.g. upon pushing a start button, or fully automatically, e.g. upon expiration of a certain time frame. Such launching mechanisms may use various ball actuators such as spring-biased actuation or pressurized air. For example, document US 2005/0003885 discloses a roulette game system including an energizable launch device to provide the launching of the ball. A remote transmitter is controlled by a push button which may generate a start game signal that is then transmitted to an electronic random time delay circuit that is capable of energizing the launch mechanism at a random time delay after it has itself been energized.

Furthermore, US 2010/0124966 discloses a roulette game system wherein the ball may be launched by means of applying an accelerating force to the ball by air discharged from discharge openings provided in an edge portion of the gaming area. Starting and stopping the discharge of the pressurized air is controlled by a timer, wherein bet end timing is set through an external operation by staff in a game hall or a controller so as to make sure that it is impossible or at least to add difficulty to predict a location at which the ball falls.

Furthermore, document US 2010/0144419 discloses a multiplayer roulette game system which enables a plurality of players to simultaneously place bets. In operation, each player places one or more bets using a wager station adjacent to the wheel assembly of the roulette game system. After all bets are placed, a dealer spins the wheel and launches the ball to start the game.

Document U.S. Pat. No. 5,588,650 discloses an automated roulette device with a plurality of player's consoles which are provided with ball launch control buttons for controlling the speed and moment of release of a ball onto the spinning roulette wheel. The player whose turn it is to release the ball, is determined in accordance with a predetermined pattern, wherein a panel of the console of the player whose turn it is to release the ball, is illuminated so as to signal to the player s/he may start the game. However, such game starting routing may be anticipated by players after some rounds of playing and/or by means of watching other players' consoles, thus creating opportunity to manipulate the starting process and reducing the game's unpredictability.

Furthermore, document US 201070210337 A1 discloses a game system including a plurality of slot machines which may switch to a roulette game when a combination of bonus symbols stop in a winning line, wherein other slot machines may participate in a second game played on a separate second game device when such switching to the roulette game occurs.

SUMMARY OF THE INVENTION

It is a general objective underlying the present invention to provide for an improved multiplayer gaming system avoiding disadvantages of the prior art and achieving improved functionality. Another more particular objective underlying the present invention is to provide for an improved multiplayer ball game system having an increased security against manipulation and providing for a reliably variable launching of the ball into the gaming area. Another particular objective underlying the invention is to provide for an improved multiplayer gaming system that adds difficulty to predict a location where the ball will fall. Finally, it is also desired to increase the level of interest, excitement and volatility associated with playing the game.

According to the present invention, such objective is achieved by a multiplayer gaming system as defined in claim 1. Preferred embodiments of the invention are laid down in the dependent claims.

More particularly, to achieve at least one of the aforementioned objectives, the present invention provides for use of various ones of the gaming terminals for starting the ball launch procedure and to allow for variation of the ball launch procedure by means of variation of the respective one of the gaming terminals that may initiate a respective game.

In accordance with the present invention, the input device of each gaming terminal includes start signal input means for inputting a start signal for starting the launching mechanism, wherein the start control means of the gaming system includes a selector for variably selecting one of the plurality of gaming terminals for each game to generate the start signal and a display signal generator for generating a display signal indicative of the gaming terminal selected for the generation of the start signal. The selector includes a random signal generator for randomly selecting the gaming terminals for the generation of the start signal. For example, a random number generator may be provided for generating random numbers and selecting a respective one of the gaming terminals on the basis of numbers associated therewith. Depending on the random signal, for each game, another one of the gaming terminals may be selected, wherein it is also possible to have one gaming terminal selected for two, three or more consecutive games to generate the respective start signals and to change the gaming terminal for generation of the start signal after two, three or more consecutive games. For example, the random signal generator may select another gaming terminal each second game or each third game to generate the start signals, wherein, however, it is also possible to vary the number of consecutive games after which another one of the gaming terminals is selected for generation of the start signal.

The aforementioned start signal input means may be provided immediately at a respective gaming terminal, for example in terms of a push button or touch screen field forming part of the input device of the respective gaming terminal. Such input means may be fixedly connected to the gaming terminal or, in the alternative, or in addition, such start signal input means may include remote control means such as a foot pedal or a hand control unit that can be actuated by a player standing in front of the respective gaming terminal.

The selection of the respective one of the gaming terminal for the respective game may be effected in different modes, wherein it is preferably effected in such a way that for a predetermined number of games, which number is preferably sufficiently large, a uniform distribution over the gaming terminals is provided, that is to say each of the gaming terminals is selected a comparable number of times for being enabled for the generation of the start signal. In accordance with an alternative starting or selecting mode, which mode may be available in addition to the random signal selection mode, the selector may include a logic unit for automatically selecting, the gaming terminal for the generation of the start signal in accordance with a predetermined logical function. For example, a very basic embodiment of such function may provide for selecting another gaming terminal for each game in accordance with a predetermined order. For example, a first terminal may be selected for a first game, a second terminal may be selected for a second game, a third terminal may be selected for a third game etc., wherein the first terminal may be selected again after each terminal has been selected once.

In accordance with a preferred embodiment of the invention, all gaming terminals of the gaming system may be selected for the generation of the start signal to initiate the launching process so that each player has the option of being selected for generating the start signal. In the alternative, it is also possible in accordance with another embodiment of the invention that the plurality of gaming terminals which are able to be selected for the generation of the start signal are only a subgroup of the entire number of gaming terminals of the gaming system. For example, a plurality of master gaming terminals may be used for the selection procedure leading to the generation of the start signal whereas at least one secondary gaming terminal may not be allowed to generate the start signal. Choosing a subgroup of all gaming terminals for the aforementioned selection process can be advantageous in particular when one or more gaming terminals are not attended by any player what may be determined on the basis of the status of the gaming terminals and/or the status of predictions and/or bets made on the respective gaming terminals. For example, gaming terminals where no bets or predictions have been entered may be disregarded. In the alternative or in addition, choosing a subgroup of all terminals for the aforementioned selection process also can be made on the basis of other criteria such as a number of bonus games or the amount of the bet placed so that a respective terminal may quality for being selected when a sufficiently high bet was entered.

In addition to using a random number generator for selecting the starter terminal and/or the aforementioned determination of a subgroup for the selection process, other criteria can be taken into account for the selection of the gaming terminal to be enabled to generate the start signal. For example, the selector may select the terminal at which the highest wager or the lowest wager has been made for the game to be started. In the alternative, the terminal at which the highest win occurred during a preceding game can be selected for the generation of the start signal. On the other hand, it is also possible to select the gaming terminal which did not have any win in the preceding game or did have the lowest win in the last game or for a predetermined number of preceding games. In the alternative, the selector may select the terminal having the highest amount stored in its credit storage. Other criteria using information provided by the game controller can be considered for the selection process.

Such criteria as mentioned before also may be used in combination with the aforementioned random number generation and/or in combination with the aforementioned subgrouping of the terminals. For example, the selector may determine the terminal that made the highest win in the preceding game, the terminal that made the lowest win in the preceding game and the terminal at which the highest wager has been made for the game to be started. Then the random number generator may select one of these three gaming terminals that were predetermined on the basis of the aforementioned criteria.

So as to make a player aware of the fact that s/he has been selected and is entitled to generate the start signal, a respective display signal is generated to indicate the outcome of the selection process. Such display signal may be displayed at different locations, wherein e.g. a central screen may be used to indicate the number of the gaming terminal where the start signal can be generated. In the alternative or in addition to such central display, the display signal indicative of the selected gaming terminal can be displayed directly at the selected gaming terminal. The gaming terminals may include display means that are responsive to the aforementioned display signal so that upon selection of the respective gaming terminal, the selected gaming terminal displays a signal indicating to the player that s/he may enter the start signal. Such display means may include visual or acoustic devices, wherein in accordance with an embodiment of the invention a display such as a monitor may be provided so as to display the invitation to enter the start signal. Such invitation may be a text message or any other symbol displayed on the monitor. In addition or in the alternative, the start signal input means may be provided with light signaling means for displaying a light signal, e.g. a flashing light indicating that the start signal input means are ready to be operated respectively the terminal is enabled for the generation of the start signal.

The aforementioned display signal indicative of the selected gaming terminal may be generated immediately upon having effected the selection of the gaming terminal for the generation of the signal. In the alternative, the said display signal indicating the outcome of the selection can be delayed and provided a certain time period after having effected the selection. Such delay allows for an early selection of the "next" gaming terminal, for example already during a preceding game or during bet time, thereby reducing downtimes and delays. On the other hand, the provision of the display signal may be controlled independently from the end of the selection procedures and/or on the basis of other criteria such as the time frame for placing bets and making predictions. For example, the display signal indicative of the selected gaming terminal may be controlled to occur and/or to be displayed immediately upon the end of the bet time.

As long as attention is given to the display signal indicative of the selected terminal, it is basically possible to have all start signal input means of all gaming terminals in the active and operative state. However, according to a preferred embodiment, measures are taken to prevent unselected gaming terminals from providing start signals by mistake or careless players. More particularly, the start control means may include a start signal processor for receiving and processing the start signals of all gaming terminals, wherein said start signal processor is adapted to identify the received starting signals in terms of a determination from which gamin terminal the respective signal comes from, and to forward only the starting signal of the one gaming terminal that was selected for generation of the starting signal and to disregard starting signals of unselected other gaming terminals.

In the alternative or in addition to such start signal identification and processing, the start signal input means of unselected gaming terminals may be deactivated and/or only the start signal input means of the selected gaming terminal may be activated. The start control means may include corresponding activating and/or deactivating means to effect activation and deactivation of the start signal input means. Such deactivator and/or such activator ma be implemented on various sections of the system architecture, e.g., the gaming terminals themselves may be provided with such activating and/or deactivating means responsive to, e.g., the display signal indicative of the selected gaming terminal so as to effect activation and/or deactivation in response to the received display signal. Depending on the structure of the start signal input means, only activation or only deactivation may be provided, wherein e.g. only deactivation may be provided when the start signal input means are, in their basic status condition, active. In the alternative, the respective input means usually may be kept deactivated and only upon receipt of the respective selection signal the start signal input means of the selected gaming terminal may be activated.

The start signal provided by a selected gaming terminal may be used so as to immediately start the launching mechanism, wherein the launching mechanism may be adapted to be responsive immediately upon receipt of the starting signal. According to an alternative embodiment of the present invention, a certain time of delay may be provided between the generation of the start signal and indeed starting the launching process. In particular, according to an advantageous embodiment of the present invention, the start control means may include a random timeout delay for providing as random delay upon receipt of the start signal from the selected gaming terminal so as to activate the launching mechanism with a random delay upon receipt of the start signal from the selected gaming terminal. Such random delay circuit provides for a further increased variation of the starting process and thus a further increased safety and security against influences where the ball might stop.

According to a further preferred embodiment of the present invention, the start control means may be responsive to a timer device providing for a certain time frame for placing predictions and/or bets on the outcome of a game, wherein the selector is adapted to select the gaming terminal for the generation of a start signal at a predetermined point of time relative to said time frame and/or to generate the display signal indicative of the selected gaming terminal at a predetermined point of time relative to said time frame. For example, a gaming terminal may be selected for the generation of the start signal already during bet time, whereas the outcome of the selection process can be displayed immediately upon or a certain period of time after the end of the time frame for placing the bets.

The selection of the gaming terminals which may activate the launching mechanism may be effected at different sections of the system's architecture, wherein depending on the system architecture different modules may be provided with the different elements of the start control means such as the separator and the display signal generator. According to a preferred embodiment of the invention, the gaming system may include a game server that is provided between the gaming terminals and the ball game device, wherein such game server is, on the one hand, connectable to the gaming terminals and, on the other hand, to the ball game device. Such game server allows for convenient communication and coordination of the game terminals with the game device. In case such game server is present, the start control means, in particular the selector for selecting the game terminals and/or the display signal generator for generating the display signal indicative of a selected game terminal may be included in such game server or connectable to such game server. In particular, the game server may include a random signal generator for selecting the respective one of the gaming terminals for the generation of the start signal.

On the other hand, such game server is not necessarily part of the multiplayer game system. Depending on the capabilities of the ball game device, the game terminals may directly communicate with the game device.

If a game server is present or not, the elements of the start control means, in particular the selector and/or the display signal generator may be part of the ball game device or may be connected to the ball game device. In the alternative or in addition to such start control facilities at the ball game device, one or more of the gaming terminals may be provided with such start control means, wherein in particular the aforementioned selector and/or the aforementioned display signal generator may be included in or connectable to at least one of the gaming terminals. Provision of the said start control elements in a plurality of gaming terminals further increases the systems' architecture against central attacks against the central game server.

BRIEF DESCRIPTION OF THE DRAWINGS

In the following, the present invention is described in further detail on the basis of preferred embodiments in connection with corresponding drawings. In the drawings show.

DETAILED DESCRIPTION

Figure 2:
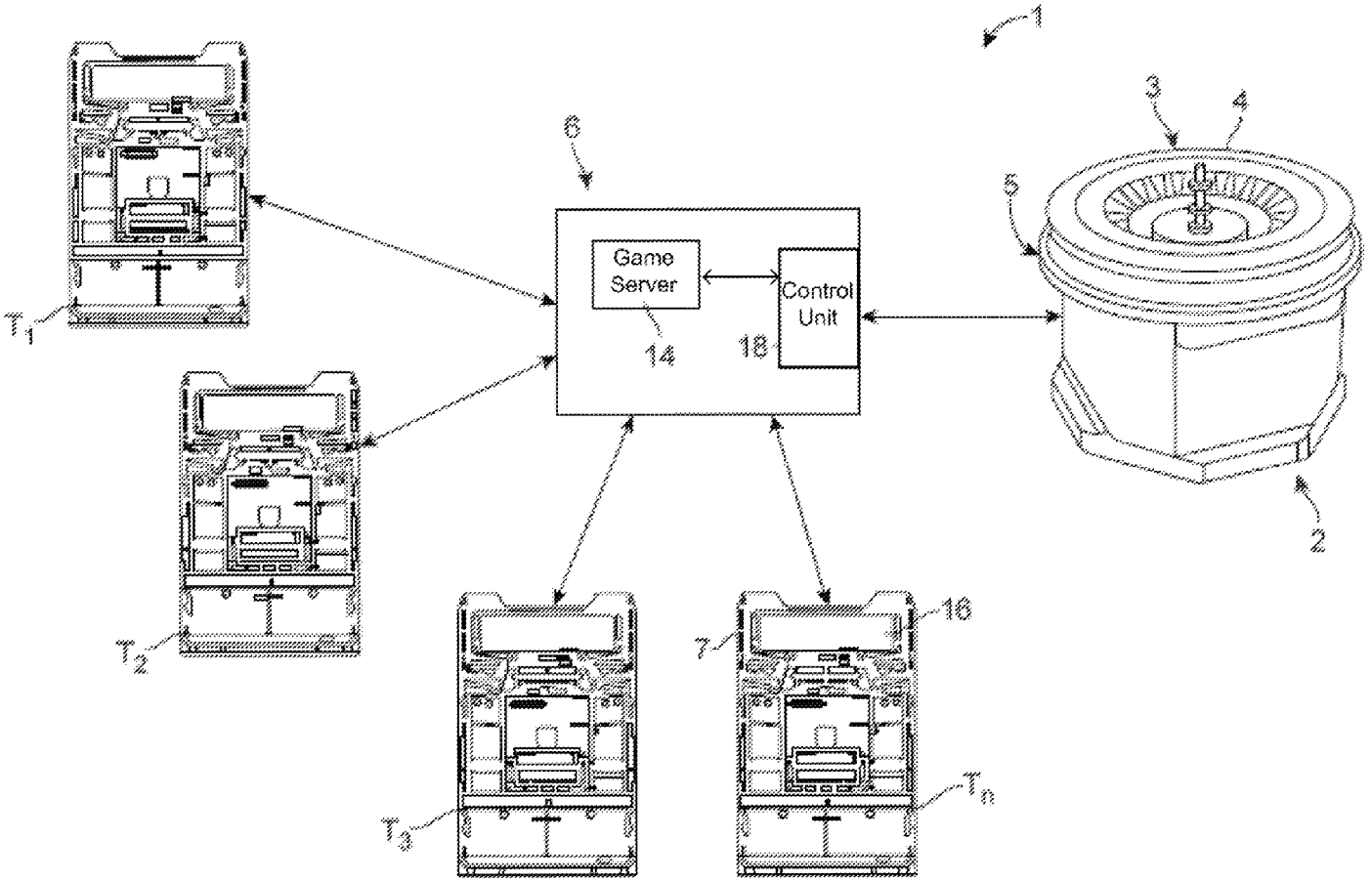
FIG. 2: a schematic overview of a multiplayer gaming system for playing roulette in accordance with a preferred embodiment of the invention showing a plurality of gaming terminals and a ball game device in terms of a roulette game device, wherein the earning terminals are connectable to a control unit that is also connected to the ball game device.

As can be seen from FIG. 2, a ball game device 2 may be adapted to play the game of roulette. A gaming area 3 of the ball game device 2 may include a spinning wheel 4 which may be provided with a ring of pockets or landings in which a ball launched into the gaming area 3 may stop. As well-known from roulette games, such pockets or landings may be associated with numbers so that the number of the pocket where the ball stops is the winning number.

The ball game device 2 may be provided with a launching mechanism 5 for launching the ball semi-automatically into the gaining area 3, wherein a start control means 6 is provided for controlling the start of such launching mechanism 5.

The gaming system 1 further comprises a plurality of gaming terminals T1, T2, T3, Tn which may be standalone devices or may be part of a multi-user playing station. Each gaming terminal is provided with communication means so as to be able to communicate with the ball game device 2 either directly or indirectly via a game server as will be described.

Figure 1:
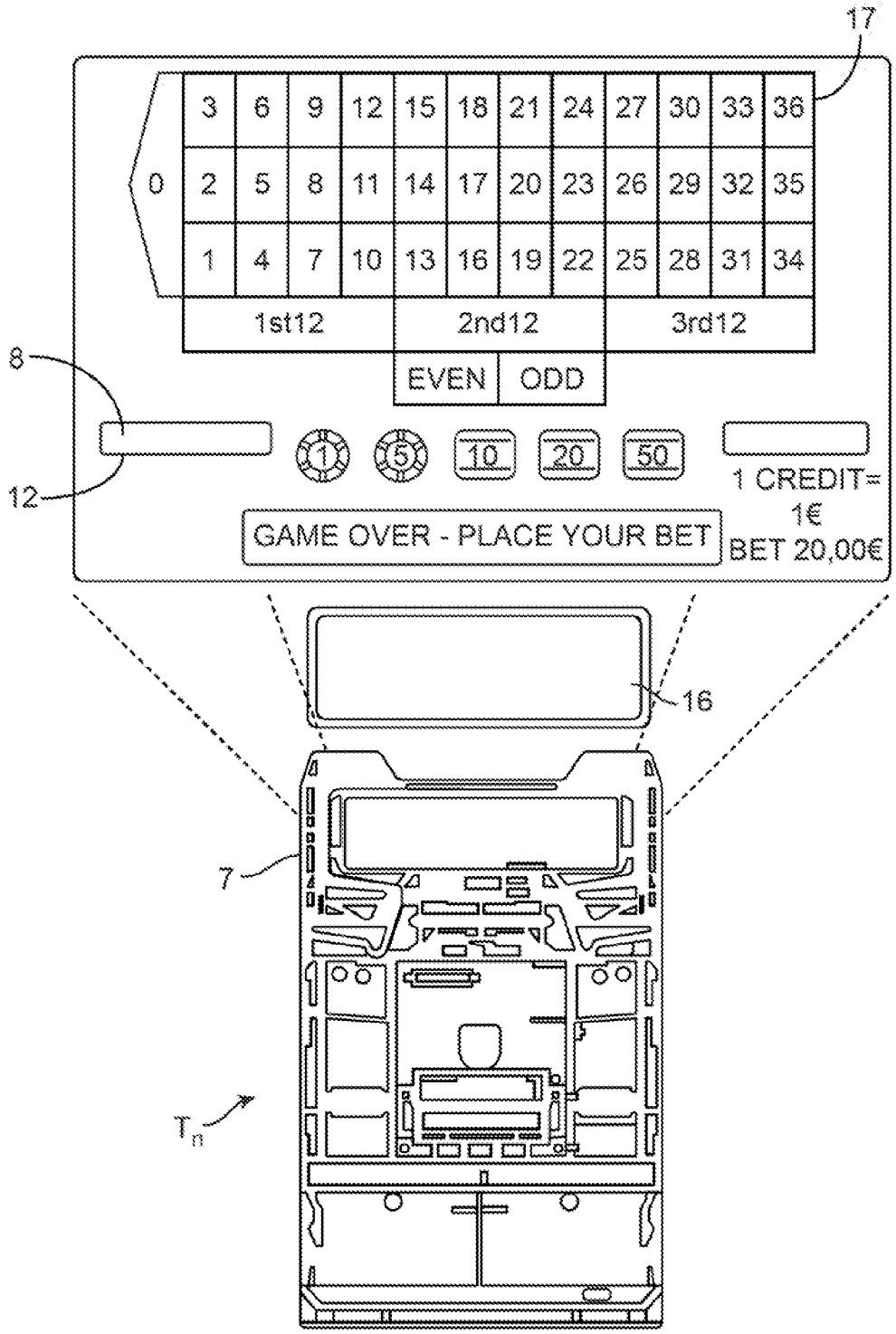
FIG. 1: a schematic view of a gamine terminal connectable to a multi-user gaming system for playing roulette in accordance with a preferred embodiment of the invention, wherein the gaming terminal's display is shown in an increased detailed view above the terminal.

As can be seen from FIG. 1, each gaming terminal T1, T2, T3 or Tn is provided with a display device 16 which may include a monitor, preferably in terms of a touch screen so as to display information relative to the ball game and/or information relative to placing bets and/or making predictions depending on whether the gaming system is playable with money or free of money.

In particular, as shown by FIG. 1, the screen of the display device 16 may be adapted to display a wagering field, sometimes referred to as the betting layout. Such wagering field 17 may include a template which specifies a grid of numbers and betting options, wherein the numbers in the grid may correspond to the numbers in the pockets of the spinning wheel 4. Each graphical wagering layout enables a player to select desired numbers and betting combinations for their wagers. For example, a touch screen may allow for identifying a desired amount of credit by means of touching, the respective coin symbol and, e.g., in a second step to place such amount of money on a specific number, e.g., by means of touching the respective number in the grid of numbers.

Furthermore, as shown by FIG. 1, the display device 16 also may be used so as to display further information such as, e.g., the time frame for placing bets which, e.g., may include the invitation "Game over—place your bet" as shown in FIG. 1.

In addition to such input means, the input device 7 which may be implemented by the aforementioned touch screen, may include start signal input means 8 which may be implemented by a respective display symbol on the aforementioned touch screen. Such start signal input means 8 allows for inputting a start signal at the touch screen of the gaming terminal.

Which terminal is allowed to generate such start signal is determined by the start control means 6 which may include a respective selector 9 for selecting one of the gaming terminals for generating the start signal of a respective game.

Figure 3:
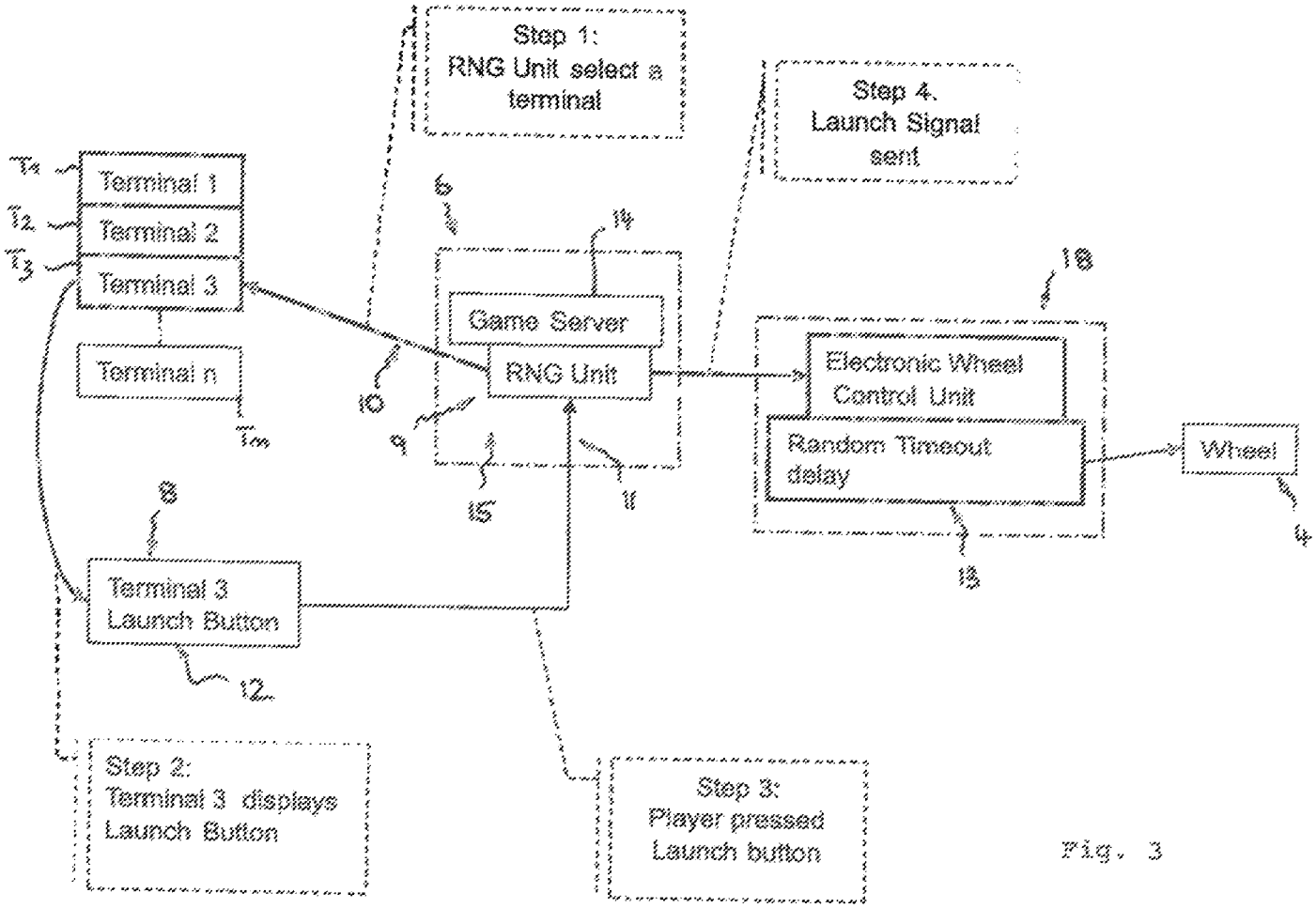
FIG. 3: a schematic view of the system architecture of the gaming system of FIG. 2 in accordance with a first preferred embodiment of the invention, wherein a game server is provided between the gaming terminals and the control unit for the gaming device, wherein the game server is provided with a random number generator for randomly selecting the game terminals for the generation of the start signals.

As shown by FIG. 3, such start control means 6 may be implemented in a game server 14 which may be provided between the launching mechanism 5 of the ball game device 2 and the gaming terminals T1, T2, T3, Tn. More particularly, as shown by FIG. 3, the game server 14 may be provided with or connected to a random number generator RNG which randomly provides for numbers that corresponds to numbers associated to the respective gaming terminals. For example, if there are gaming terminals T1, T2, T3, Tn, the random number generator RING randomly issues one of the numbers T1, T2, T3, Tn.

As can be seen from FIG. 3, in a first step the selector 9 being provided with the aforementioned random signal generator RNG selects in a first step one of the gaming terminals to be enabled for generation of the start signal, wherein in the example of FIG. 3 terminal number 3 is selected.

As shown by FIG. 3, such invitation respectively enablement to enter the start signal may be implemented in terms of displaying a launch button on the touch screen of the gaming terminal T3 in a step 2 subsequent the aforementioned step 1. For example, the launch button may be displayed by display means 12 in terms of a blinking light so that the player realizes s/he now may push the launch button.

Entering, the start signal is then step 3 of the launch procedure. Upon pressing the displayed launch button, the gaming terminal 3 sends a start signal to the game server 14 which, upon receipt of such start signal forwards the signal to the launching mechanism 5 of the ball game device 2.

The launching mechanism 5 may immediately start launching the ball into the gaming area or, in the alternative, may provide for a random timeout delay so as to start the launching process with a certain delay upon receipt of the start signal.

Figure 4:
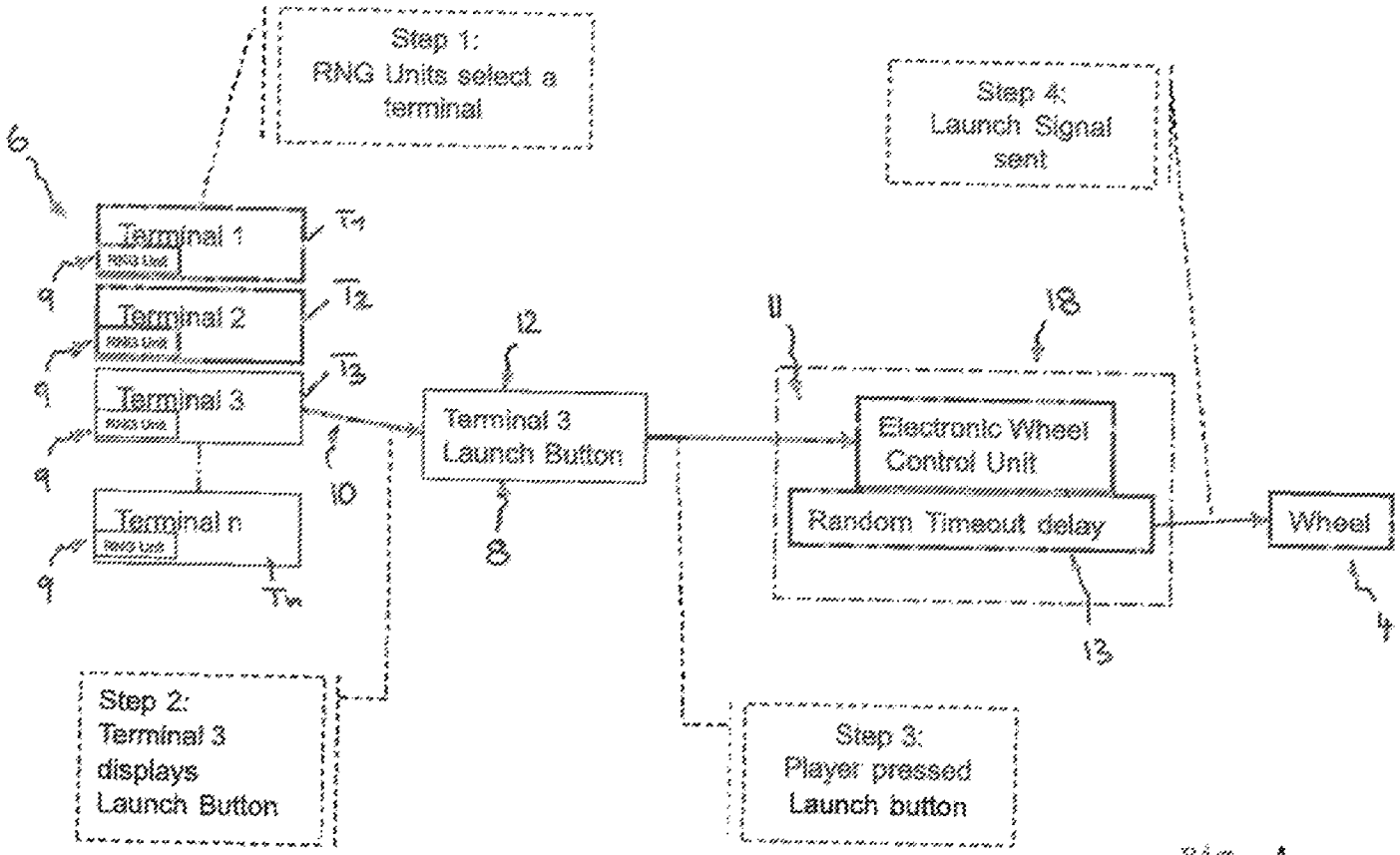
FIG. 4: a schematic view of the system architecture of the gaming system of FIG. 2 according to a further preferred embodiment of the invention, wherein the terminals are directly communicating with the control unit for controlling the game device, wherein the game terminals are provided with random number generators for selecting a terminal to provide for the launch signal.

As can be seen from FIG. 4, use of a game server 14 provided between the ball game device 2 and the gaming terminals is not necessary, but the gaming terminals T1, T2, T3, Tn may directly communicate with the ball game device 2.

Furthermore, as FIG. 4 shows, the start control means 6 may be implemented in at least one of the gaming terminals, wherein preferably each gaming terminal T1, T2, T3, Tn may be provided with a selector 9 including a random signal generator RNG so that the selection of a respective one of the gaming terminals for the generation of the start signal can be effected by the gaming terminals themselves. Preferably, the gaming terminals may communicate with each other so as to control the selection process.

In FIG. 4 again terminal number 3 is selected for providing the start signal so that the display device 16 of the gaming terminal T3 again may display a launch button to invite the player to enter the launch signal. Upon touching the launch button at terminal 3, said terminal 3 send a start signal directly to the ball game device 2 or the control unit connected thereto so as to activate the launching mechanism 5.

Figure 5:
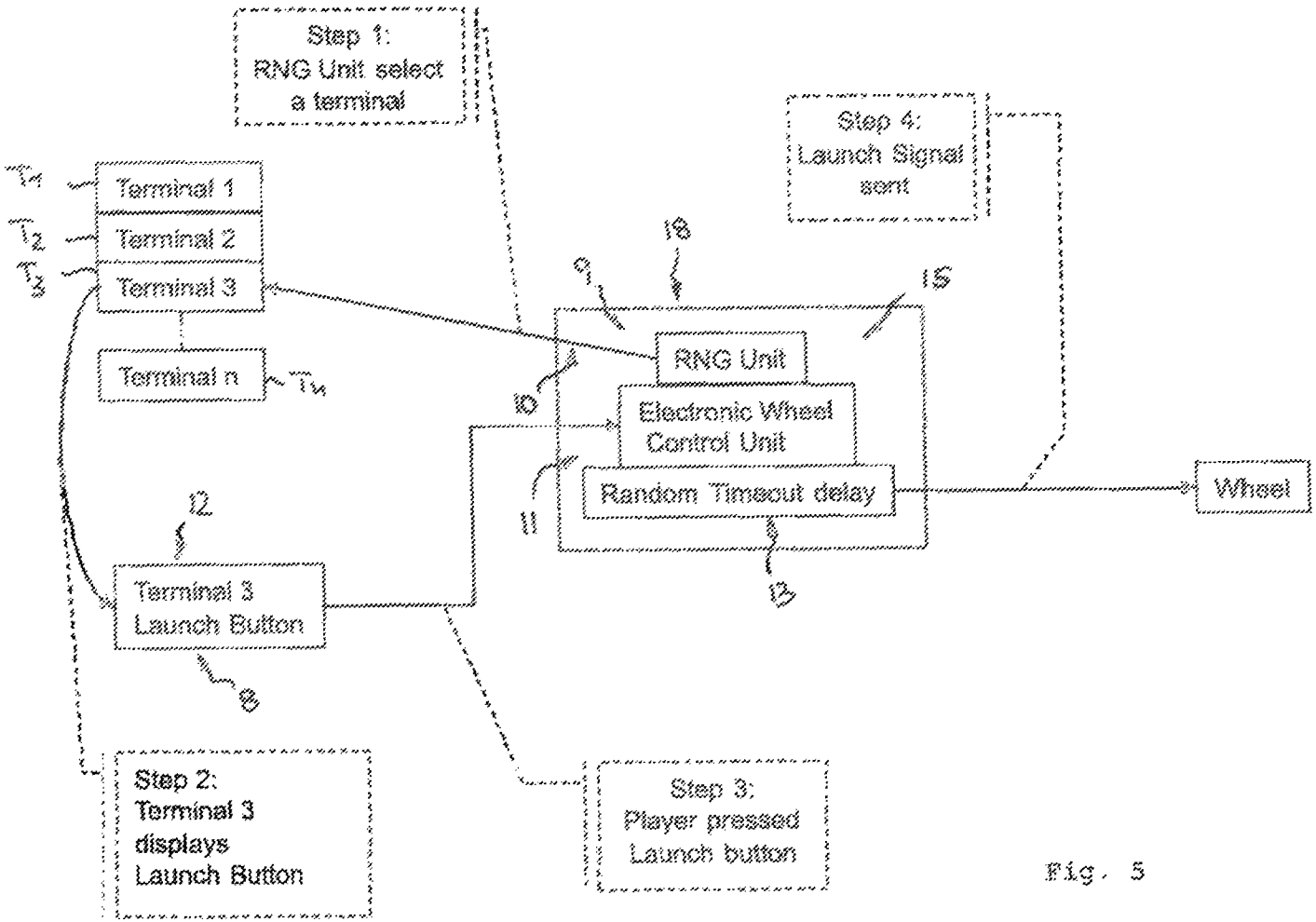
FIG. 5: a schematic view of the system architecture of the gaining system of FIG. 2 according to a still further preferred embodiment of the invention, wherein the control unit of the ball game device is provided with a random number generator for randomly selecting the gaming terminals.

In a still further embodiment that is shown in FIG. 5, the start control means 6 may be implemented in the control unit associated with the ball game device 2. In particular, the control unit of the ball game device 2 may include a random number generator RNG for randomly selecting one of the gaming terminals for the generation of the start signal. Aside from this difference in the system's architecture, the embodiment of FIG. 5 corresponds to FIG. 4 so that a corresponding launching procedure including the aforementioned steps 14 may be effected to start a game.

In addition to or in the alternative to such random number generator RNG, the selection of the gaming terminal to be enabled for generating the start signal may be effected on the basis of other selection criteria such as the highest or lowest wager made for the game to be started, the highest win made in the preceding game, the lowest win made in the preceding game, no win made in the preceding game or the highest amount stored in the credit storage of a terminal, wherein it is also possible to combine such selection criteria with a random number generator RNG. For example, the aforementioned criteria may be used so as to preselect a subgroup of terminals, wherein the random number generator RNG then selects one of the terminals of such predetermined subgroup for the generation of the start signal.

What is claimed is:

1. A multiplayer gaming system comprising:

a plurality of gaming terminals, wherein each of the plurality of gaming terminals comprises:

an acceptor configured to accept a physical item from a player, the physical item being associated with a monetary value to establish a credit balance, a display device, an input device configured to accept a wager and a prediction concerning an outcome of a wagering game, wherein the wager is deducted from the credit balance, and wherein each of the plurality of gaming terminals has a number associated with the gaming terminal; and a ball game device comprising:

a gaming area;

a launching mechanism configured to launch a ball into the gaming area in connection with the wagering game; and a control unit, wherein the control unit is in communication with the plurality of gaming terminals and wherein the control unit comprises a random number generator configured to generate a number at random and a timer device configured to establish a time frame to place at least one of the wager and the prediction, wherein the control unit is configured to select the gaming terminal using the number generated by the random number generator at a first point in time within the time frame, wherein the display device of the gaming terminal selected at random by the control unit is controlled to begin displaying a start signal at a second point in time after the time frame, wherein the launching mechanism is configured to launch a ball into the gaming area in response to the player applying a user input to the start signal displayed on the display device, and wherein the display device is configured to display a cashout button in connection with a payout from the credit balance to the player based on the outcome of the wagering game.

2. The system of claim 1, wherein the control unit further comprises a random timeout delay controller configured to provide a random delay upon receiving the user input applied to the start signal, wherein the random delay delays the launching of the ball into the gaming area.

3. The system of claim 1, wherein the control unit further comprises an activator configured to activate the display device of the gaming terminal selected at random to display the start signal and wherein the control unit further comprises a deactivator configured to deactivate the display devices of the remaining gaming terminals to not display the start signal.

4. The system of claim 1, wherein the ball game device comprises a rotatably supported wheel forming at least a part of the gaming area, wherein the launching mechanism is configured to launch the ball onto the rotatably supported wheel as part of the wagering game.

5. The system of claim 1, wherein the start signal is generated by the player activating a launch button displayed on the display device of the gaming terminal selected at random.

6. A multiplayer gaming system comprising:

a ball game device comprising:

a gaming area, and a launching mechanism configured to launch a ball into the gaming area in connection with a wagering game; and a plurality of gaming terminals, wherein each of the plurality of gaming terminals has a number associated with the gaming terminal, wherein at least one of the plurality of gaming terminals further comprises a timer device configured to establish a time frame to place at least one of a wager and a prediction, and wherein each of the plurality of gaming terminals comprises:

an acceptor configured to accept a physical item from a player, the physical item being associated with a monetary value to establish a credit balance, a display device, an input device configured to accept the wager and the prediction concerning an outcome of the wagering game, wherein the wager is deducted from the credit balance, and a random number generator configured to generate a number at random, wherein at least one of the plurality of gaming terminals is selected using the number generated at random by the random number generator and the number associated with the respective gaming terminal, wherein the gaming terminal selected using the random number generator is selected at a first point in time within the time frame, wherein the gaming terminal selected at random is controlled to begin displaying a start signal using the display device of the gaming terminal at a second point in time after the time frame, wherein the launching mechanism is configured to launch a ball into the gaming area in response to the player applying a user input to the start signal displayed on the display device, and wherein the display device is configured to display a cashout button in connection with a payout from the credit balance to the player based on the outcome of the wagering game.

7. The system of claim 6, wherein at least one of the plurality of gaming terminals further comprises a random timeout delay controller configured to provide a random delay upon receiving the user input applied to the start signal, wherein the random delay delays the launching of the ball into the gaming area.

8. The system of claim 6, wherein at least one of the plurality of gaming terminals further comprises an activator configured to activate the display device of the gaming terminal selected at random to display the start signal and wherein the at least one of the plurality of gaming terminals further comprises a deactivator configured to deactivate the display devices of the remaining gaming terminals to not display the start signal.

9. The system of claim 6, wherein the start signal is generated by the player activating a launch button displayed on the display device of the gaming terminal selected at random.

10. The system of claim 6, wherein the ball game device comprises a rotatably supported wheel forming at least a part of the gaming area, wherein the launching mechanism is configured to launch the ball onto the rotatably supported wheel as part of the wagering game.

11. A method of operating a wagering game, the method comprising:

accepting, with an acceptor of a gaming terminal, a physical item from a player, the physical item being associated with a monetary value to establish a credit balance based on the monetary value, wherein the gaming terminal is one of a plurality of gaming terminals of a multiplayer gaming system;

establishing, using a timer device of the start controller of the multiplayer gaming system, a time frame to place at least one of a wager and a prediction;

accepting, via an input device of the gaming terminal, the wager and the prediction concerning an outcome of the wagering game, wherein the wager is deducted from the credit balance;

selecting at random, using a random number generator of a start controller, at least one of the plurality of gaming terminals to control the launching of a ball into a gaming area of a ball game device at a first point in time within the time frame;

causing a display of the gaming terminal to begin displaying, at a second point in time after the time frame, a start signal configured to receive a user input from the player at the gaming terminal, wherein the start signal indicates the gaming terminal is selected to launch the ball into the gaming area;

receiving, from the gaming terminal selected, a user input applied to the start signal;

launching, using a launching mechanism of the gaming system, a ball into the gaming area in connection with the wagering game in response to the user input received from the gaming terminal selected at random; and initiating, via a cashout button of at least one of the plurality of gaming terminals, a payout from the credit balance to the player based on the outcome of the wagering game.

12. The method of claim 11, further comprising adding a random delay using a random timeout delay controller upon receiving the user input applied to the start signal, wherein the random delay delays the launching of the ball into the gaming area.

13. The method of claim 11, wherein the random number generator is part of a game server in communication with the plurality of gaming terminals and the ball game device.

14. The method of claim 11, wherein the ball game device comprises a rotatably supported wheel forming at least part of the gaming area, wherein the launching mechanism is configured to launch the ball onto the rotatably supported wheel as part of the wagering game.

* * * * *